US011676786B2

(12) United States Patent
Carlson et al.

(10) Patent No.: US 11,676,786 B2
(45) Date of Patent: Jun. 13, 2023

(54) SYSTEMS AND METHODS FOR CONTROLLING CONTACTOR OPEN TIME

(71) Applicant: Rockwell Automation Technologies, Inc., Mayfield Heights, OH (US)

(72) Inventors: Andrew E. Carlson, Franklin, WI (US); Kyle B. Adkins, Oak Creek, WI (US); David M. Messersmith, Milwaukee, WI (US)

(73) Assignee: ROCKWELL AUTOMATION TECHNOLOGIES, INC., Mayfield Heights, OH (US)

( * ) Notice: Subject to any disclaimer, the term of this patent is extended or adjusted under 35 U.S.C. 154(b) by 252 days.

(21) Appl. No.: 16/844,101

(22) Filed: Apr. 9, 2020

(65) Prior Publication Data

US 2021/0319967 A1 Oct. 14, 2021

(51) Int. Cl.

| | |
|---|---|
| ***H01H 47/02*** | (2006.01) |
| ***H01H 47/22*** | (2006.01) |
| ***H01H 50/44*** | (2006.01) |
| ***H01H 50/64*** | (2006.01) |

(52) U.S. Cl.

CPC ..... *H01H 47/02* (2013.01); *H01H 47/22* (2013.01); *H01H 50/44* (2013.01); *H01H 50/643* (2013.01)

(58) Field of Classification Search

CPC ..... H01H 47/02; H01H 47/22; H01H 50/44; H01H 50/643; H01H 50/002; H01H 47/325; H01H 9/56; H02H 1/06

See application file for complete search history.

(56) References Cited

U.S. PATENT DOCUMENTS

| | | | | |
|---|---|---|---|---|
| 3,790,862 | A | 2/1974 | Kampf | |
| 8,116,059 | B2 | 2/2012 | Critchley | |
| 8,164,865 | B2 | 4/2012 | Critchley | |
| 2003/0160517 | A1 | 8/2003 | Lo | |
| 2007/0223172 | A1* | 9/2007 | Gauxmann | H01F 7/1816 361/147 |
| 2012/0327549 | A1* | 12/2012 | Chaly | H01H 33/6662 361/160 |
| 2014/0049114 | A1 | 2/2014 | Chen | |
| 2018/0151321 | A1 | 5/2018 | Gorenflo | |
| 2019/0035583 | A1* | 1/2019 | Yin | H01H 47/001 |

OTHER PUBLICATIONS

Extended European search report issued for European application No. 21164878.7 dated Sep. 6, 2021, 13 pages.

* cited by examiner

*Primary Examiner* — Bernard Rojas

(57) ABSTRACT

A device includes an armature, a coil, and a circuit. The armature is configured to move between a close position that electrically couples the armature to a contact and an open position that is not electrically coupled to the contact. The coil is configured to release a voltage configured to demagnetize the coil, thereby causing the armature to move from the close position to the open position. The circuit is configured to provide reverse driving current to the coil during a period of time when the armature moves from the close position to the open position.

20 Claims, 12 Drawing Sheets

SYSTEMS AND METHODS FOR CONTROLLING CONTACTOR OPEN TIME

TECHNICAL FIELD

This application relates generally to switch devices, and more particularly to systems and methods for controlling contactor open time of switch devices.

BACKGROUND

Switching devices are generally used throughout industrial, commercial, material handling, process and manufacturing settings, to mention only a few. As used herein, "switching device" is generally intended to describe any electromechanical switching device, such as mechanical switching devices (e.g., a contactor, a relay, air break devices, and controlled atmosphere devices) or solid-state devices (e.g., a silicon-controlled rectifier (SCR)). More specifically, switching devices generally open to disconnect electric power from a load and close to connect electric power to the load. For example, switching devices may connect and disconnect three-phase electric power to an electric motor. As the switching devices open or close, electric power may be discharged as an electric arc and/or cause current oscillations to be supplied to the load, which may result in torque oscillations. To facilitate reducing likelihood and/or magnitude of such effects, the switching devices may be opened and/or closed at specific points on the electric power waveform. Such carefully timed switching is sometimes referred to as "point on wave" or "POW" switching. However, the opening and closing of the switching devices are generally non-instantaneous. For example, there may be a slight delay between when the make instruction is given and when the switching device actually makes (i.e., closes). Similarly, there may be a slight delay between when break instruction is given and when the switching device actually breaks (i.e., opens). Accordingly, to facilitate making or breaking at a specific point on the electric power waveform, a number of embodiments may be employed to enable the switching device to operate with respect to a specific point on the electrical power waveform. As such, the present disclosure relates to various different technical improvements in the field of POW switching, which may be used in various combinations to provide advances in the art.

SUMMARY

The following presents a simplified summary of the claimed subject matter in order to provide a basic understanding of some aspects described herein. This summary is not an extensive overview, and is not intended to identify key/critical elements or to delineate the scope of the claimed subject matter. Its sole purpose is to present some concepts in a simplified form as a prelude to the more detailed description that is presented later.

One embodiment is a device that includes an armature, a coil, and a circuit. The armature is configured to move between a close position that electrically couples the armature to a contact and an open position that is not electrically coupled to the contact. The coil is configured to release a voltage configured to de-magnetize the coil, thereby causing the armature to move from the close position to the open position. The circuit is configured to provide reverse driving current to the coil during a period of time when the armature moves from the close position to the open position.

Another embodiment is a circuit configured to provide reverse coil drive current. The circuit includes a coil, a first power source, a first switch, and a second switch. The first power source is connected to a second end of the coil. The first switch is connected to a first end of the coil. The second switch is connected to the second end of the coil. When the first switch and the second switch is turned on, current from the first power source is enabled to flow through the coil from the second end to the first end.

Another embodiment is a method of driving coil of a switching system. The method includes: enabling, by a circuit, current flowing through a coil in a forward direction to magnetize the coil thereby changing the switching system from an open state to a closed state; disabling, by the circuit, current flowing through the coil in the forward direction; and enabling, by the circuit, current flowing through the coil in a reverse direction to eliminate core flux of the coil.

The following description and annexed drawings set forth certain illustrative aspects of the specification. These aspects are indicative, however, of but a few of the various ways in which the principles of the specification can be employed. Other advantages and novel features of the specification will become apparent from the following detailed description of the specification when considered in conjunction with the drawings.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As described above, switching devices are used in various implementations, such as industrial, commercial, material handling, manufacturing, power conversion, and/or power distribution, to connect and/or disconnect electric power from a load. To consistently implement POW switching, a number of factors may be taken into consideration to ensure that the respective switching device opens within a consistent amount of time after receiving a signal causing the respective switching device to open. That is, a coil drive circuit that controls the opening of the switching device may be affected by a coil resistance, a temperature, a coil supply voltage, a coil inductance, and the like. The present embodiments described herein assists the switching device to open within a precise and consistent time frame that may enable the POW switching operations to be more effective.

The present embodiments may also employ one or more reverse current circuits to drive the coil. The reverse current circuit may enable the switching device to open more consistently and accurately over various coil resistances (e.g., +/−10%), various temperatures (e.g., additional +/−10% on coil resistance), various coil supply voltages (e.g., +/−5%), various coil inductance (e.g., additional +/−400% on coil inductance), and armature wear over the life of the switching device. Additional details for employing reverse current circuit to drive the coil of a switching device is described below with reference to FIGS. 1-12.

Figure 1:
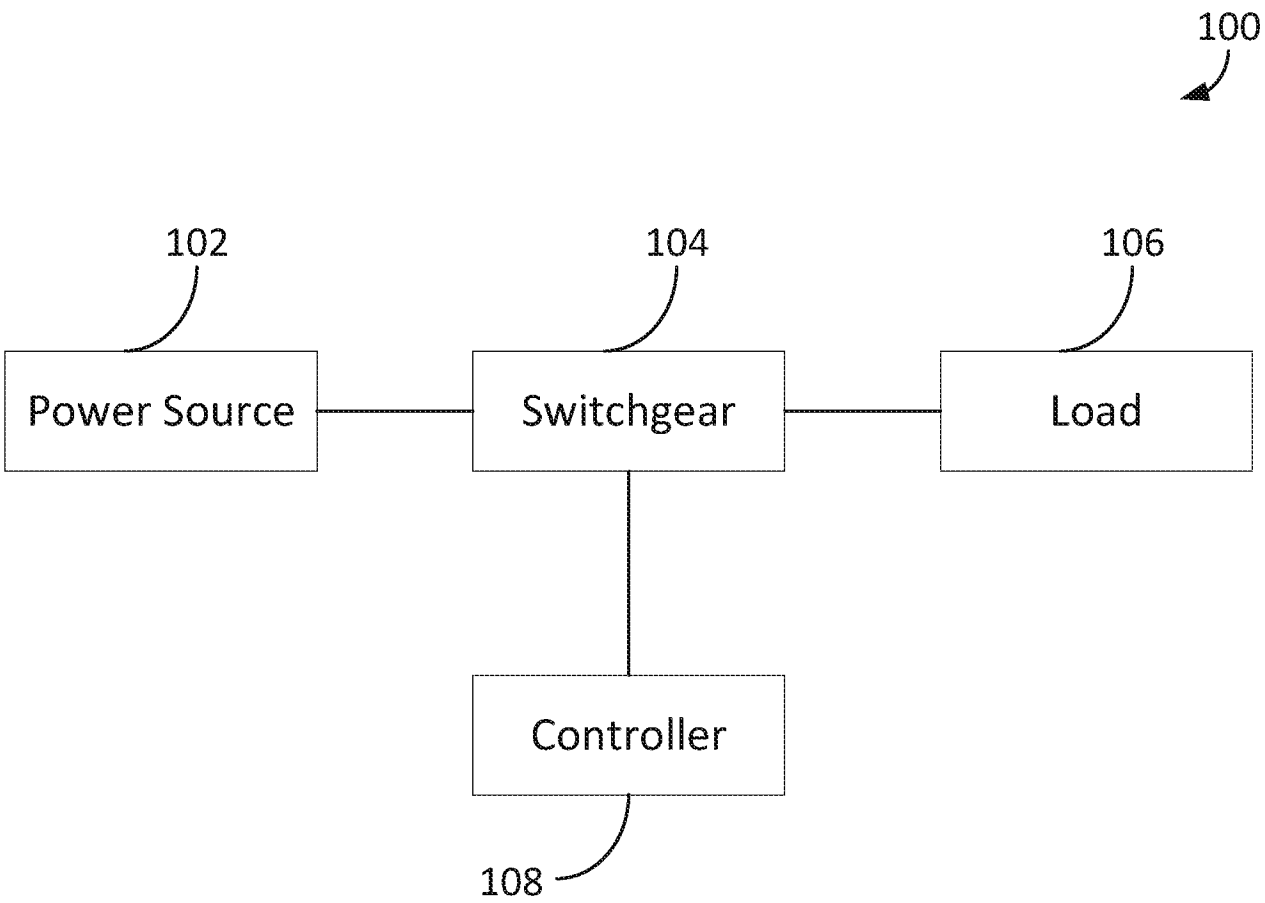
FIG. 1 is a block diagram of a power control system according to an illustrative embodiment.

FIG. 1 is a block diagram of a power control system 100 according to an illustrative embodiment. The power control system 100 includes a power source 102, a switchgear 104, a load 106, and a controller 108. The power source 102 may be any type of suitable AC or DC electric power source. In some embodiments, the power source 102 may be an electrical grid.

The switchgear 104 includes one or more switching devices that may be controlled using the systems and methods described herein. In some embodiments, the switchgear 104 controls the flow of current from the power source 102 to the load 106 based on input received from the controller 108. For example, the switchgear 104 may selectively connect and/or disconnect three-phase electric power output by the power source 102 to the load 106 according to some embodiments. The load 106 may be any power device such as an electric motor or any other powered electrical devices according to some embodiments. For example, switching devices in the switchgear 104 may close to connect electric power to the load 106. On the other hand, the switching devices in the switchgear 104 may open to disconnect electric power from the load 106.

It should be noted that the three-phase implementation described herein is not intended to be limiting. More specifically, certain aspects of the disclosed techniques may be employed on single-phase circuitry and/or for applications other than power an electric motor. Additionally, it should be noted that in some embodiments, current may flow from the source 102 to the load 106. In other embodiments current may flow from the load 106 to the source 102 (e.g., a wind turbine or another generator). More specifically, in some embodiments, current flow from the load 106 to the source 102 may transiently occur, for example, when overhauling a motor.

In some embodiments, operation of the switchgear 104 (e.g., opening or closing of switching devices) may be controlled by the controller 108. More specifically, the controller 108 may instruct the switchgear 104 to connect or disconnect electric power. Accordingly, the controller 108 may include one or more processors and memory. More specifically, as will be described in more detail below, the memory may be a tangible, non-transitory, computer-readable medium that stores instructions, which when executed by the one or more processors perform various processes described. It should be noted that non-transitory merely indicates that the media is tangible and not a signal. Many different algorithms and control strategies may be stored in the memory and implemented by the processor, and these will typically depend upon the nature of the load 106, the anticipated mechanical and electrical behavior of the load 106, the particular implementation, behavior of the switching devices, and so forth.

In some embodiments, switchgear 104 may include or function with protection circuitry and the actual switching circuitry that makes and breaks connections between the power source and the motor windings. More specifically, the protection circuitry may include fuses and/or circuit breakers, and the switching circuitry may include relays, contactors, and/or solid-state switches (e.g., SCRs, MOSFETs, IGBTs, and/or GTOs), such as within specific types of assembled equipment (e.g., motor starters).

For example, the switching devices included in the protection circuitry may disconnect the power source 102 from the load 108 when an overload, a short circuit condition, or any other unwanted condition is detected. Such control may be based on the un-instructed operation of the device (e.g., due to heating, detection of excessive current, and/or internal fault), or the controller 108 may instruct the switching devices (e.g., contactors or relays) included in the switching circuitry to open or close. For example, the switching circuitry may include one (e.g., a three-phase contactor) or more contactors (e.g., three or more single-pole, single current-carrying path switching devices).

Accordingly, to start the load 106, the controller 108 may instruct the one or more contactors in the switching circuitry to close individually, together, or in a sequential manner. On the other hand, to stop the load 106, the controller 108 may instruct the one or more contactors in the switching circuitry to open individually, together, or in a sequential manner. When the one or more contactors are closed, electric power from the power source 102 is connected to the load 106 or adjusted and, when the one or more contactors are open, the electric power is removed from the load 106 or adjusted. Other circuits in the system may provide controlled waveforms that regulate operation of the load 106 (e.g., motor drives, automation controllers, etc.), such as based upon movement of articles or manufacture, pressures, temperatures, and so forth. Such control may be based on varying the frequency of power waveforms to produce a controlled speed of the load 106.

In some embodiments, the controller 108 may determine when to open or close the one or more contactors based at least in part on the characteristics of the electric power (e.g., voltage, current, or frequency) measured by the sensors. Additionally, the controller 108 may receive an instruction to open or close the one or more contactors in the switchgear 104. In some embodiments, the controller 108 may be a programmable logic controller (PLC) that locally (or remotely) controls operation of the power control system 100. Accordingly, the controller 108 may include one or more processor and memory. More specifically, the memory 46 may be a tangible non-transitory computer-readable medium on which instructions are stored. As will be described in more detail below, the computer-readable instructions may be configured to perform various processes described when executed by the one or more processor. In some embodiments, the controller 108 may also be included within the switchgear 104.

Figure 2:
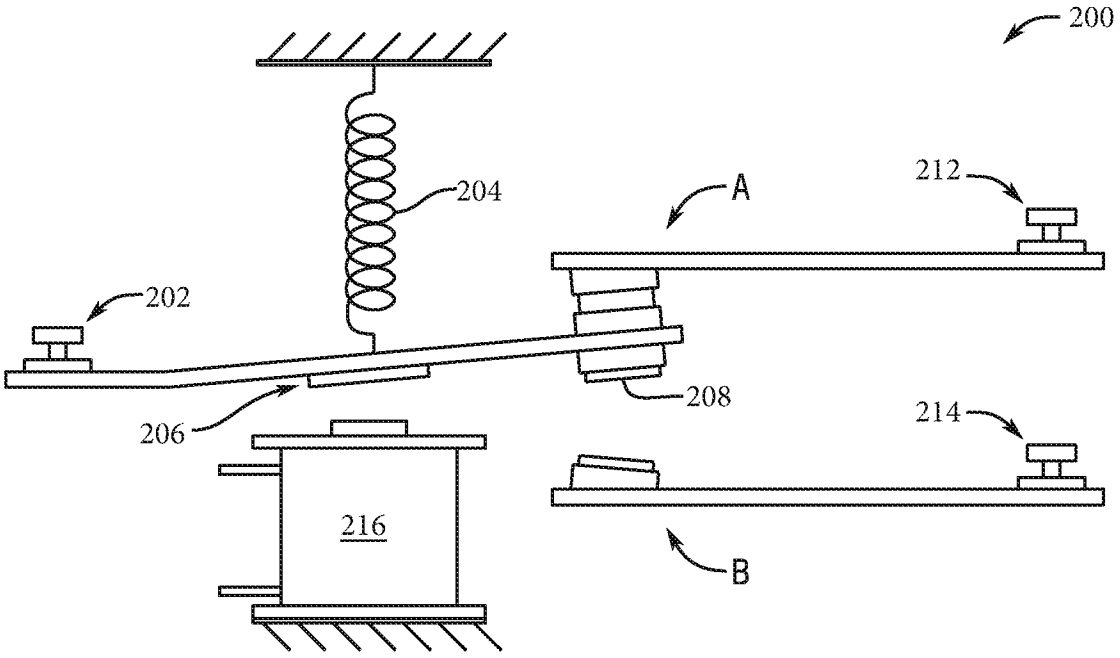
FIG. 2 is a system view of an example single-pole, single current-carrying path relay device according to an illustrative embodiment.

FIG. 2 is a system view of an example single-pole, single current-carrying path relay device 200 according to an illustrative embodiment. The relay device 200 may be included in the switchgear as illustrated in FIG. 1. The relay device 200 includes an armature 206 that is coupled to a spring 204. The armature 206 may have a common contact 202 that may be coupled to a part of an electrical circuit. The armature 206 includes a contact 208. The contact 208 may be electrically coupled to a contact 212 (e.g., a normally close contact) through a contact A when a coil 216 of the relay device 200 is de-energized (e.g., no current flow through). The contact 208 may be electrically coupled to a contact 214 (e.g., a normally open contact) through a contact B when the coil 216 is energized (e.g., with current flow through). When the contact 208 is coupled to the contact 212, current flow through the contact 202 to the contact 212 and the relay device is in OFF state. When the contact 208 is coupled to the contact 214, current flow through the contact 202 to the contact 214 and the relay device 200 is in On state. The operation of switching the relay device 200 between OFF state and ON state is controlled by the current flow through the coil 216 that provided by a drive circuit connected to the coil 216. As mentioned above, a precise and consistent relay open time is required for proper operation. It is advantageous to provide a precise and consistent control of the relay open operation. The present disclosure provides one or more coil drive circuits to reduce relay open time tolerance and drift and to provide consistent relay open time independent of component tolerances, temperature, and relay life.

Figure 3:
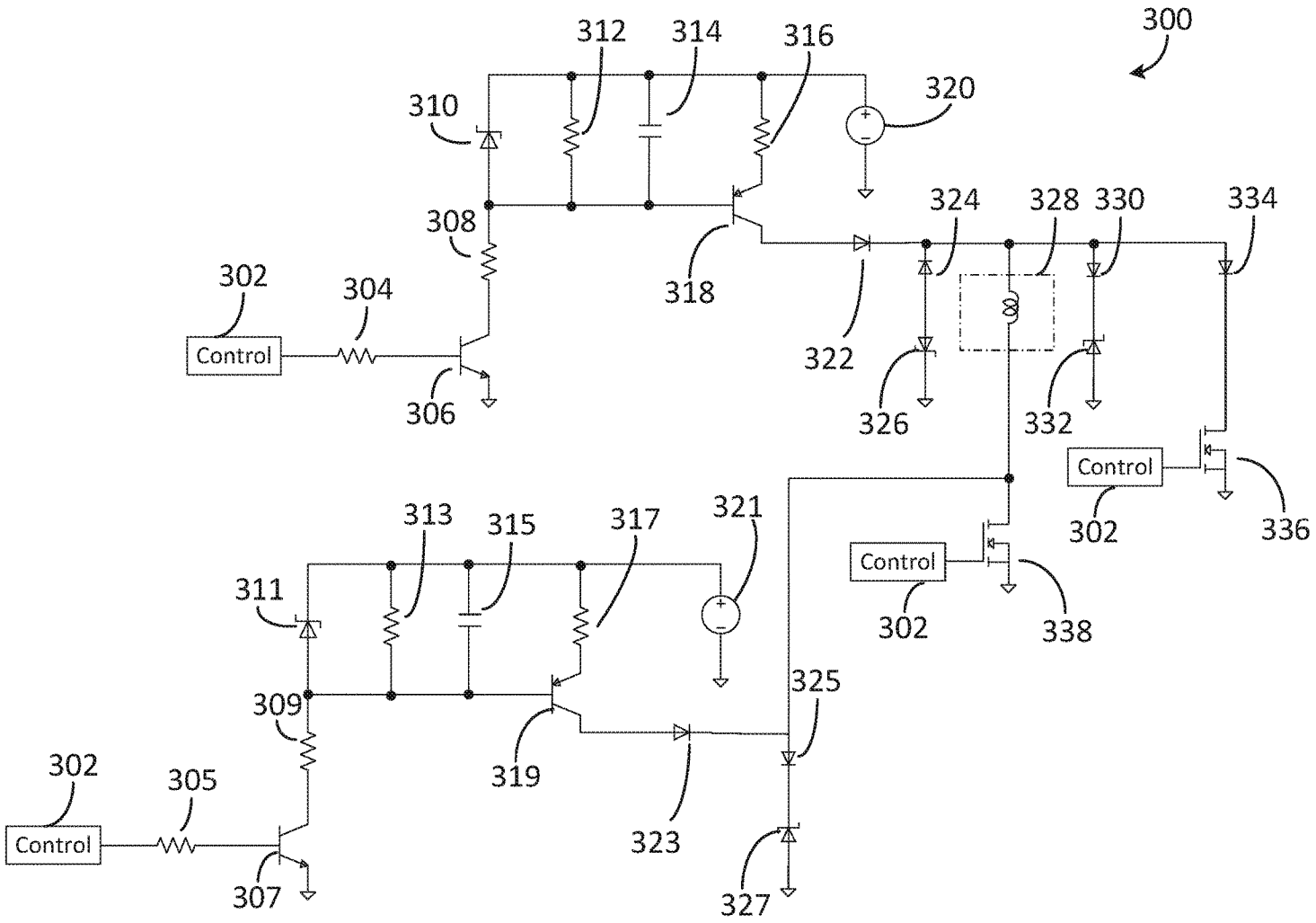
FIG. 3 is a circuit diagram for providing reverse current to a coil of a power control system according to an illustrative embodiment.

FIG. 3 shows a circuit 300 that is employed to provide reverse current to a coil of a power control system according to an illustrative embodiment. The circuit 300 includes a coil 328, a first power source 320, a second power source 321, and a control system 302. The coil 328 (e.g., a relay coil) is used to control movement of a contact in a switch of the power control system. The power sources 320 and 321 are arranged in opposite directions across the coil 328 to provide forward and reverse current flow through the coil 328. The power sources 320 and 321 may be DC power sources. In some embodiments, the power sources 320 and 321 may be AC power sources. In some embodiments, the power source 320 and 321 may be one power source.

The first power source 320 is configured to provide current to the coil 328 in a first direction (e.g., forward direction). Current from the first power source 320 is controlled by a switch 318, a switch 306, and a switch 338. In some embodiments, a resistor 316 may be disposed between the first power source 320 and the switch 318 to absorb voltage. The switch 318 is controlled by voltage at a gate terminal. The gate terminal of the switch 318 is connected to a node between a resistor 312 and a resistor 308 and further connected to the switch 306. The switch 306 is controlled by control signals received from the control system 302. In some embodiments, a resistor 304 may be disposed between the control system 302 and the switch 306 to absorb voltage. When the control system 302 applies a voltage at a gate terminal of the switch 306 and the applied voltage reaches a threshold of the switch 306, the switch 306 closes to allow current flowing from the first power source 320 through the resistor 312 and the resistor 308. When the voltage between the resistors 308 and 312 reaches a threshold of the switch 318, the switch 318 closes to allow current flowing from the first power source 320 to the coil 328 in the first direction. The switch 338 received control signal (e.g., voltage) at a gate terminal from the control system 302. When the voltage applied at the gate terminal of the switch 338 reaches a threshold, the switch 338 closes. When the switches 318 and 338 are both closed, current flow through the coil 328 in the first direction. In other words, the coil 328 is energized. In some embodiments, a Zener diode 310 and a capacitor 314 may be disposed in parallel with the resistor 312 as a voltage regulator to provide a constant voltage to the resistor 312. In some embodiments, a diode 322 is connected between the switch 318 and the coil 328 to block reverse current. In some embodiments, a diode 324 and a Zener diode 326 are coupled in a back to back configuration, e.g., where the anodes of both diodes are coupled together, in parallel to the coil 328. The diode 324 and the Zener diode 326 are configured to quickly reduce forward current (e.g., current in the first direction) through the coil 328 until the coil 328 is fully discharged.

The second power source 321 is configured to provide current to the coil 328 in a second direction (e.g., reverse direction). Current from the second power source 321 is controlled by a switch 319, a switch 307, and a switch 336. In some embodiments, a resistor 317 may be disposed between the second power source 321 and the switch 319 to absorb voltage. The switch 319 is controlled by voltage at a gate terminal. The gate terminal of the switch 319 is connected to a node between a resistor 313 and a resistor 309 and further connected to the switch 307. The switch 307 is controlled by control signals received from the control system 302. In some embodiments, a resistor 305 may be disposed between the control system 302 and the switch 307 to absorb voltage. When the control system 302 applies a voltage at a gate terminal of the switch 307 and the applied voltage reaches a threshold of the switch 307, the switch 307 closes to allow current flowing from the second power source 321 through the resistor 313 and the resistor 309. When the voltage between the resistors 309 and 313 reaches a threshold of the switch 319, the switch 319 closes to allow current flowing from the second power source 321 to the coil 328 in the second direction. The switch 336 received control signal (e.g., voltage) at a gate terminal from the control system 302. When the voltage applied at the gate terminal of the switch 336 reaches a threshold, the switch 336 closes. When the switches 319 and 336 are both closed, reverse current flow through the coil 328 in the second direction. In some embodiments, back electromotive force (EMF) may be generated by the coil 328 in response to the sudden loss of current supplied by the first power source 320. The reverse current provided to the coil 328 absorbs the back EMF energy. In some embodiments, a Zener diode 311 and a capacitor 315 may be disposed in parallel with the resistor 313 as a voltage regulator to provide a constant voltage to the resistor 313. In some embodiments, a diode 323 is connected between the switch 319 and the coil 328 to block reverse current. In some embodiments, a diode 330 and a Zener diode 332 are coupled in a front to front configuration, e.g., where the cathodes of diode 330 and the Zener diode 332 are coupled together, in parallel to the coil 328. The front-to-front configured diodes 330 and 332 are configured to quickly release reverse current through the coil 328 until the coil 328 is fully discharged. In some embodiments, a diode 325 and a Zener diode 327 are coupled in a front to front configuration and in parallel to the coil 328. The diode 325 and the Zener diode 327 are configured to reduce forward current from the coil 328. In some embodiments, the switches 306, 318, 338, 336, 307, and 319 may be any suitable type of solid-state switches (e.g., SCRs, MOSFETs, IGBTs, and/or GTOs).

Figure 4:
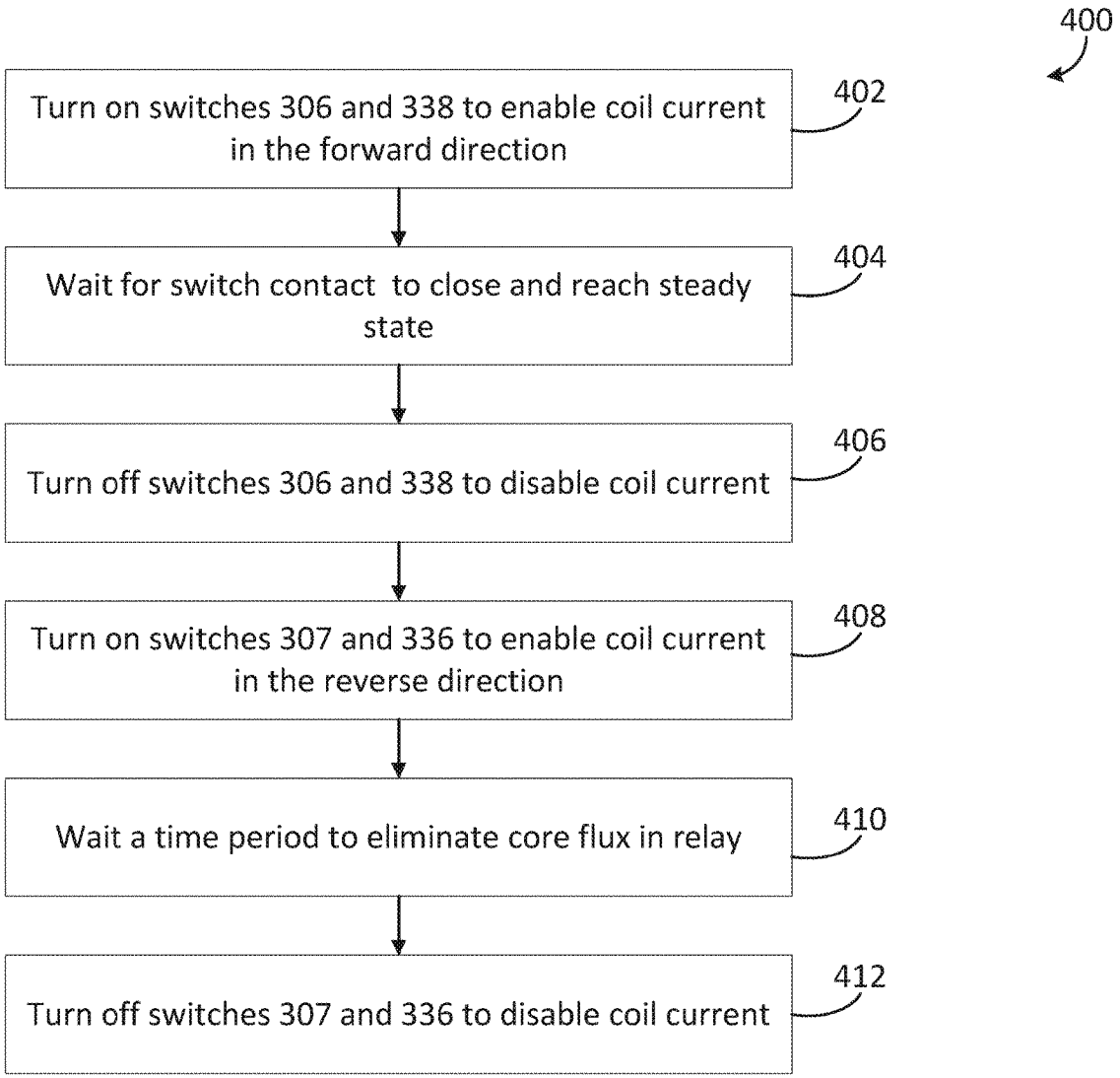
FIG. 4 is flow chart of a process of operating the circuit of FIG. 3 according to an illustrative embodiment.

FIG. 4 is flow chart of a process 400 of operating the circuit 300 of FIG. 3 according to an illustrative embodiment. The process 400 is controlled by the control system 302 to control movement of a contact in a switch of a power control system. In operation 402, switches 306 and 338 are turned on by the control system 302 to enable current from the first power source 320 to flow through the coil 328 in the forward direction. When the switch 306 is turned on, a voltage is applied to the gate terminal of the switch 318 to turn on the switch 318. Current from the first power 320 flows through the resistor 316 and the switch 318 to the coil 328. When the forward current flow through the coil 328, the coil 328 is energized to provide an electromagnetic force to close the contact of the switch.

In operation 404, the control system 302 determines whether the contact of the switch is closed and whether the closed contact reaches a steady state. Upon determining that the contact is closed and reaches a steady state, in operation 406, the control system 302 turns off switches 306 and 338 to disable the forward current flowing through the coil 328. When the forward current flow is disabled, back EMF may be generated by the coil 328 in response to the sudden loss of current supplied by the first power source 320. It is advantageous to reduce the back EMF in order to provide a precise and consistent relay open time of the power control system.

In operation 408, switches 307 and 336 are turned on by the control system 302 to enable current flow through the coil 328 in the reverse direction. The reverse current is provided by the second power source 321. The reverse current can absorb the back EMF generated by the coil 328. When the switch 307 is turned on, a voltage is applied to the gate terminal of the switch 319 and the switch 319 is turned on. Current from the second power source 321 flow through the resistor 317 and the switch 319 to the coil 328 and flow through the coil 328 in the reverse direction to the switch 336.

In operation 410, the control system 302 determines a time period for providing the reverse current in order to eliminate core flux in the switch of the power control system. In some embodiments, the time period may be related to the material of the coil 328 and/or of the power level of the first power source 320.

In operation 412, the control system 302 turns off the switches 307 and 336 to disable the reverse current flowing through the coil 328 in the reverse direction after the determined time period.

Figure 5:
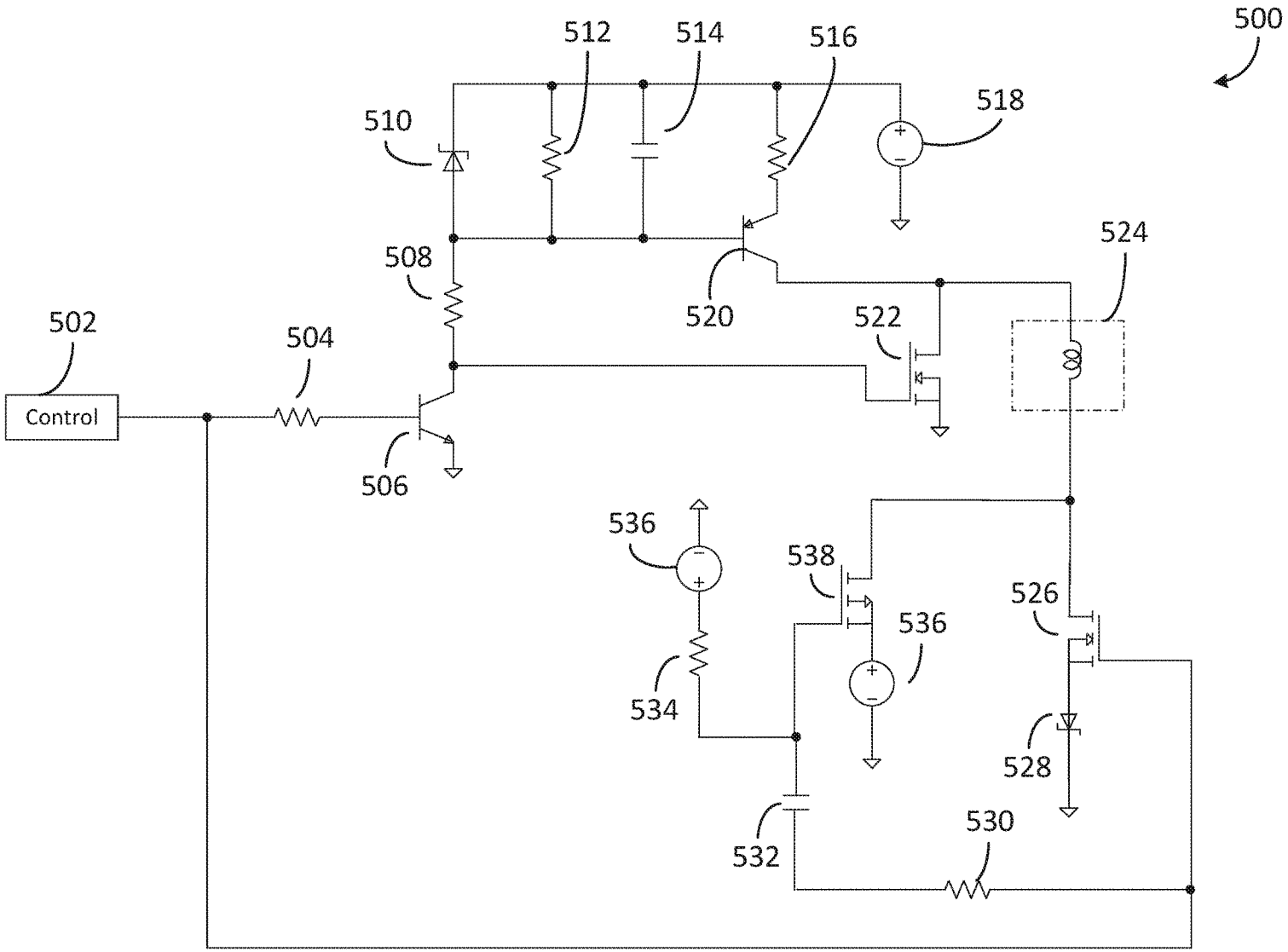
FIG. 5 is a circuit diagram for providing reverse current to a coil of a power control system according to an illustrative embodiment.

FIG. 5 shows a circuit 500 that is employed to provide reverse current to a coil of a power control system according to an illustrative embodiment. The circuit 500 includes a coil 524, a first power source 518, a second power source 536, and a control system 502. The coil 324 (e.g., a relay coil) is used to control movement of a contact in a switch of the power control system. The first power source 518 is a DC power source. The second power source 536 is an AC power source. The first power source 518 provides forward current to the coil 524 and the second power source 536 provides reverse current to the coil 524.

The first power source 518 is connected to the coil 524 through a switch 520 and a resistor 516. The first power source 518 is also connected to a switch 506 through a resistor 512 and a resistor 508. A gate terminal of the switch 506 is connected to the control system 502 through a resistor 504. A gate terminal of the switch 520 is connected to a node between the resistor 512 and the resistor 508. When the control system 502 applies a voltage at the gate terminal of the switch 506 that reaches the threshold of the gate terminal, the switch 506 closes to enable current flow from the first power source 518 through the resistor 512 and the resistor 508. When current flow through the resistor 512 and the resistor 508, the voltage at the node between the two resistors 512 and 508 is applied to the gate terminal of the switch 520 to close the switch 520. When the switch 520 is closed, current from the first power source 518 flows to a first end of the coil 524. A second end of the coil 524 is connected to a switch 526. The switch 526 is controlled by the control system 502 that is connected to a gate terminal of the switch 526. When the control system instructs the switches 506 and 526 to close, current provided by the first power source 518 flow from the first end of the coil 524 to the second end of the coil 524 (e.g., in a forward direction).

The second power source 536 is connected to a gate terminal of a switch 538 through a resistor 534. The second power source 536 is also connected to a first terminal of the switch 538. When voltage applied at the gate terminal reaches a threshold of the switch 538, the switch 538 closes to enable current from the second power source 536 flow through the switch 538. The switch 538 is connected to the second end of the coil 524. A switch 522 is connected to the first end of the coil 524. A gate terminal of the switch 522 is connected to a node between the switch 506 and the resistor 508. When the switch 506 is on, the switch 522 is off, and when the switch 506 is off, the switch 522 is on. When the switch 522 and the switch 538 are both turned on, current provided by the second power source 536 flows through the coil 524 in the reverse direction. In some embodiments, the switches 506, 520, 522, 538, and 526 may be any suitable type of solid-state switches (e.g., SCRs, MOSFETs, IGBTs, and/or GTOs). In some embodiments, a capacitor 532 and a resistor 530 are connected in parallel to the switch 538.

Figure 6:
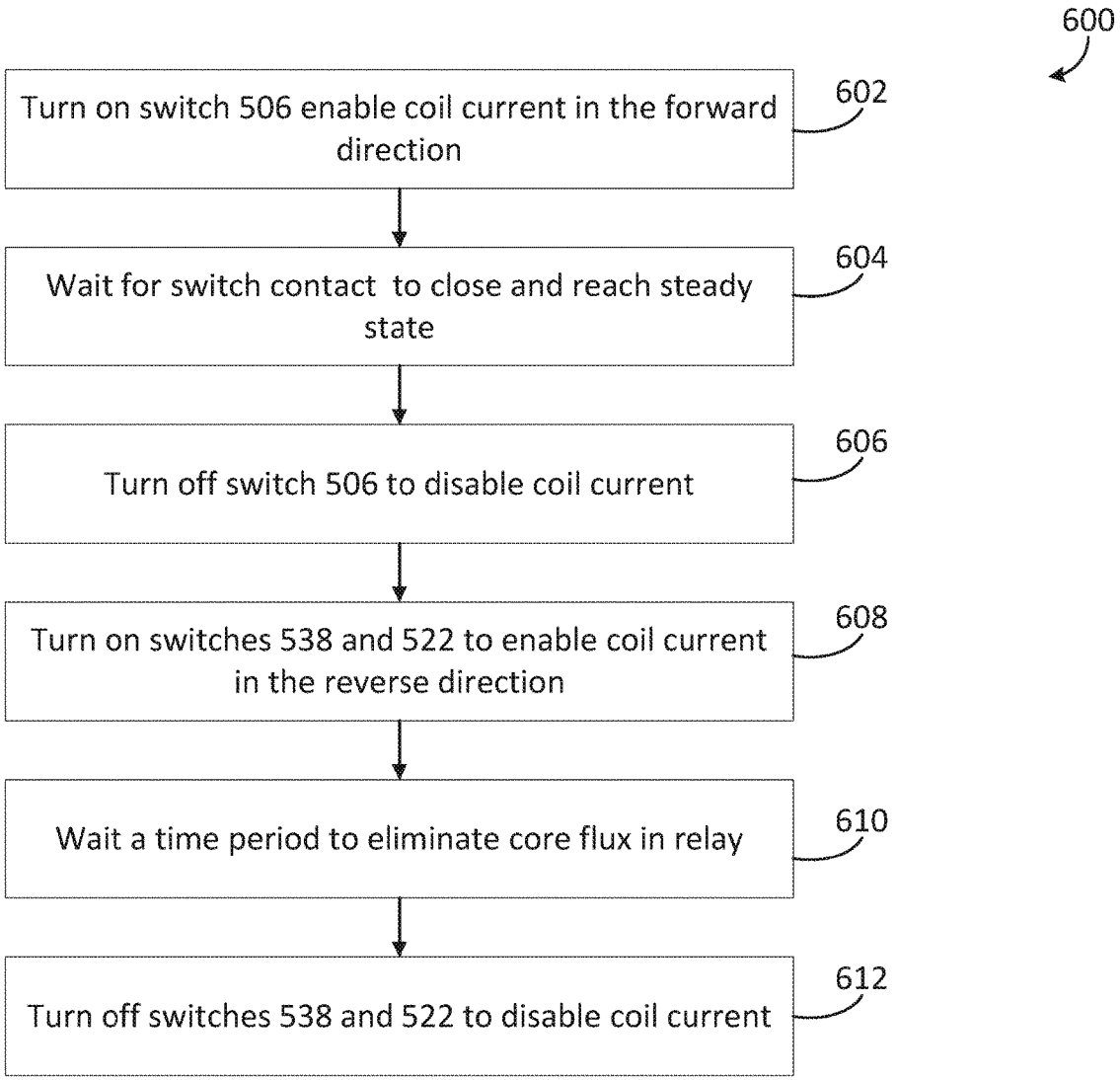
FIG. 6 is flow chart of a process of operating the circuit of FIG. 5 according to an illustrative embodiment.

FIG. 6 is a flow chart of a process 600 of operating the circuit 500 of FIG. 5 according to an illustrative embodiment. The process 600 is controlled by the control system 502 to energize or de-energize a coil in order to control movement of a contact in a switch of a power control system. In operation 602, the switch 506 is turned on by the control system. When the switch 506 is turned on, voltage is applied to the gate terminal of the switch 520 and voltage is applied to the gate terminal of the switch 526 so that the switch 520 and the switch 526 are turned on as well. Current from the first power source 518 is enabled to flow through the switch 520, the coil 524, and the switch 526.

In operation 604, the control system 502 determines whether the contact of the switch is closed and whether the closed contact reaches a steady state. Upon determining that the contact is closed and reaches a steady state, in operation 606, the control system 502 turns off switch 506 to disable the forward current flowing through the coil 524. When the forward current flow is disabled, back EMF may be generated by the coil 524 in response to the sudden loss of current supplied by the first power source 518.

In operation 608, switches 538 and 522 are turned on by the control system 502 to enable current flow through the coil 524 in the reverse direction. The switch 538 is turned on through an AC-coupling circuit formed by the resistor 530, the capacitor 532, and the resistor 534. When the control signal transitions from high-to-low, the gate-to-source voltage of the switch 538 temporarily pulses negative and is turned on through the AC coupling circuit. In some embodiments, the switch 538 is a P-channel FET. When the control signal from the control system 502 is low, the switch 522 is turned on. The reverse current is provided by the second power source 536. The reverse current can absorb the back EMF generated by the coil 524.

In operation 610, the control system 502 determines a time period for providing the reverse current in order to eliminate core flux in the switch of the power control system. In some embodiments, the time period may be related to the material of the coil 524 and/or of the power level of the first power source 518.

In operation 612, the control system 502 turns off the switches 538 and 522 to disable the reverse current flowing through the coil 524 in the reverse direction after the determined time period. When the temporary negative gate-to-source voltage pulse of the switch 538 is over, the switch 538 is turned off. The switch 522 remains on when the control signal is low. When the switch 538 is off and the switch 522 is on, the current flow through the switch 522, the Zener diode 528, and the parasitic diode of the switch 526. The Zener diode 528 provides a high-voltage clamping path which minimizes a current fall time.

Figure 7:
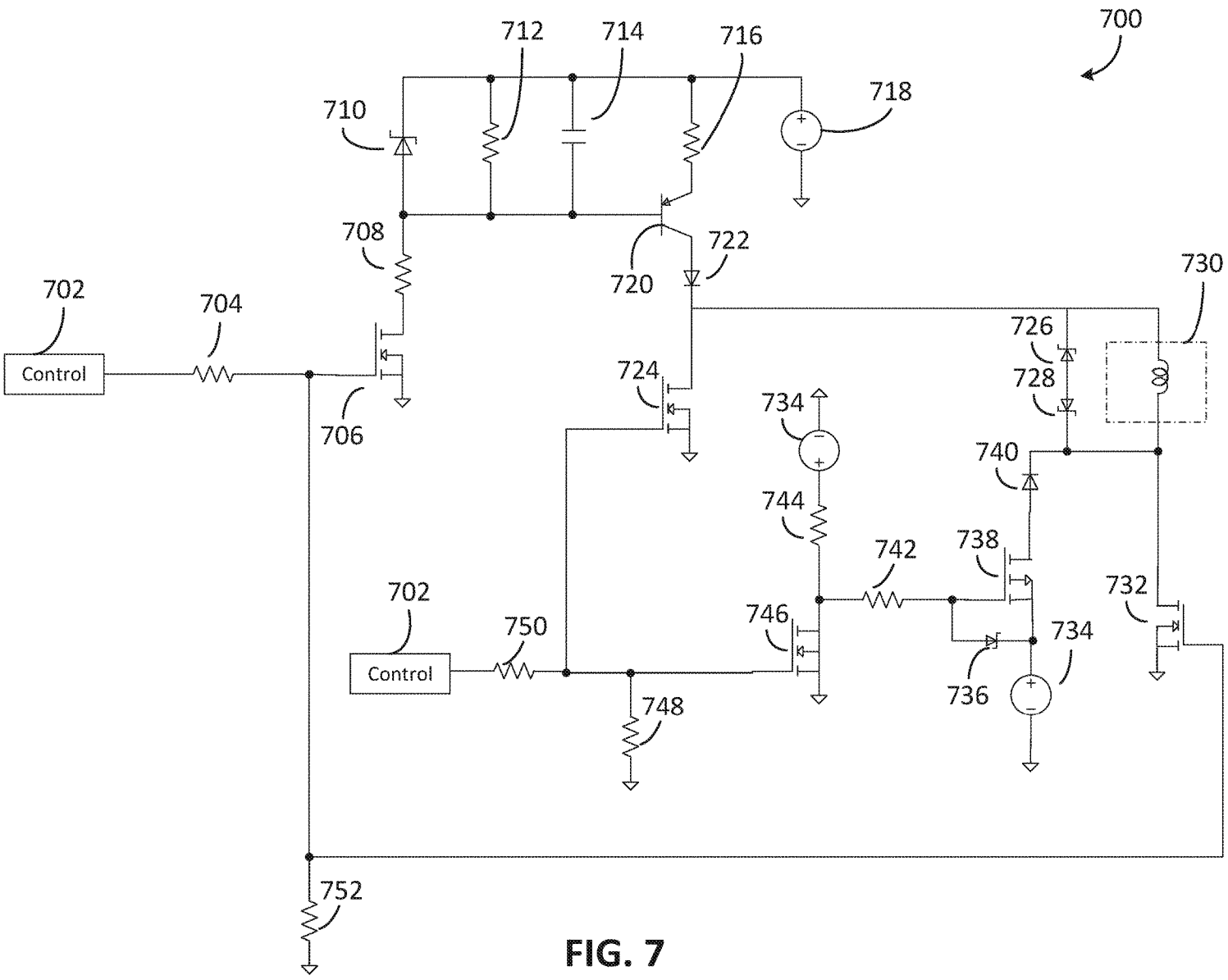
FIG. 7 is a circuit diagram for providing reverse current to a coil of a power control system according to an illustrative embodiment.

FIG. 7 shows a circuit 700 that is employed to provide reverse current to a coil of a power control system according to an illustrative embodiment. The circuit 700 includes a coil 730, a first power source 718, a second power source 734, and a control system 702. The coil 730 (e.g., a relay coil) is used to control movement of a contact in a switch of the power control system. The power sources 718 and 734 may be DC power sources. In some embodiments, the power sources 718 and 734 may be one power source. The first power source 718 is configured to provide forward voltage to the circuit 700 and the second power source 734 is configured to provide reverse voltage to the circuit 700.

The first power source 718 is configured to provide forward voltage and forward current to the coil 730 in a first direction (e.g., forward direction). Current from the first power source 718 is controlled by a switch 720, a switch 706, and a switch 732. In some embodiments, a resistor 716 may be disposed between the first power source 718 and the switch 720 to absorb voltage. The switch 720 is controlled by voltage at a gate terminal. The gate terminal of the switch 720 is connected to a node between a resistor 708 and a resistor 712 and further connected to the switch 706. The switch 706 is controlled by control signals received from the control system 702. In some embodiments, a resistor 704 may be disposed between the control system 702 and the switch 706 to absorb voltage. When the control system 702 applies a voltage at a gate terminal of the switch 706 and the applied voltage reaches a threshold of the switch 706, the switch 706 closes to allow current flowing from the first power source 718 through the resistor 712 and the resistor 708. When the voltage between the resistors 708 and 712 reaches a threshold of the switch 720, the switch 720 closes to allow current flowing from the first power source 718 to the coil 730 in the first direction. The switch 732 received control signal (e.g., voltage) at a gate terminal from the control system 702. When the voltage applied at the gate terminal of the switch 732 reaches a threshold, the switch 732 closes. When the switches 720 and 732 are both closed, current flow through the coil 730 in the first direction. In other words, the coil 730 is energized. In some embodiments, a Zener diode 710 and a capacitor 714 may be disposed in parallel with the resistor 712 as a voltage regulator to provide a constant voltage to the resistor 712. In some embodiments, a diode 722 is connected between the switch 720 and the coil 730 to block reverse current. In some embodiments, a Zener diode 726 and a Zener diode 728 are coupled in a back to back configuration, e.g., where the anodes of both diodes are coupled together, in parallel to the coil 730. The Zener diode 726 and the Zener diode 728 are configured to quickly reduce forward current (e.g., current in the first direction) through the coil 730 until the coil 730 is fully discharged when the switches 706 and 732 are open.

The second power source 734 is configured to provide reverse voltage and reverse current to the coil 730 in a second direction (e.g., reverse direction). Current from the second power source 734 is controlled by a switch 746, a switch 724, and a switch 738. In some embodiments, a resistor 744 may be disposed between the second power source 734 and the switch 746 to absorb voltage. In some embodiments, a resistor 742 may be disposed between the switch 738 and a node between the resistor 744 and the switch 746. The switch 746 is controlled by voltage at a gate terminal. The gate terminal of the switch 746 is connected to the control system 702. The switch 746 is controlled by control signals received from the control system 702. In some embodiments, a resistor 750 may be disposed between the control system 702 and the switch 746 to absorb voltage. When the control system 702 applies a voltage at a gate terminal of the switch 746 and the applied voltage reaches a threshold of the switch 746, the switch 746 closes to allow current flowing from the second power source 734 through the resistor 744 and the resistor 742. When current flows through the resistor 744, a voltage is applied to the gate terminal of the switch 738. When the voltage applied to the gate terminal of the switch 738 reaches a threshold, the switch 738 closes to enable current flow from the second power source 734 to the coil 730. In some embodiments, a Zener diode 736 is connected between the gate terminal of the switch 738 and a first terminal of the switch 738 to protect the switch 738 from overload damage. In some embodiments, a diode 740 is connected between the switch 738 and the coil 730 to block forward coil current. The switch 724 is connected between the coil 730 and the control system 702. When the switch 746 is turned on, the switch 724 is turned on as well, so that the current from the second power source 734 is enabled to flow through the switch 738, the coil 730, and the switch 724. In some embodiments, the switches 706, 720, 724, 744, 738, 732, and 746 may be any suitable type of solid-state switches (e.g., SCRs, MOSFETs, IGBTs, and/or GTOs).

Figure 8:
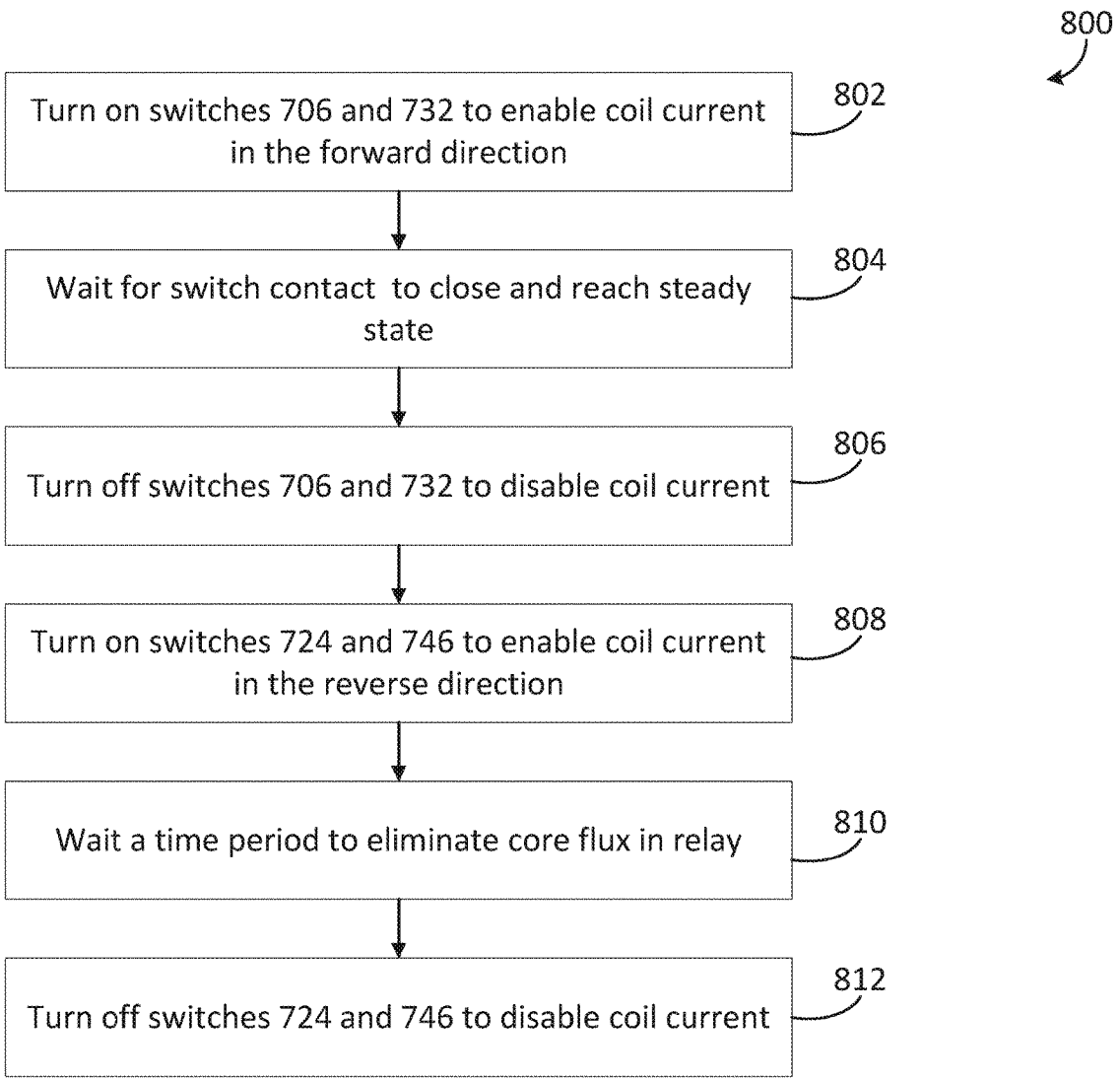
FIG. 8 is flow chart of a process of operating the circuit of FIG. 7 according to an illustrative embodiment.

FIG. 8 is flow chart of a process 800 of operating the circuit 700 of FIG. 7 according to an illustrative embodiment. The process 800 is controlled by the control system 702 to control movement of a contact in a switch of a power control system. In operation 802, switches 706 and 732 are turned on by the control system 702 to enable current from the first power source 718 to flow through the coil 730 in the forward direction. When the switch 706 is turned on, a voltage is applied to the gate terminal of the switch 720 to turn on the switch 720. Current from the first power source 718 flows through the resistor 716 and the switch 720 to the coil 730. When the forward current flow through the coil 730, the coil 730 is energized to provide an electromagnetic force to close the contact of the switch.

In operation 804, the control system 702 determines whether the contact of the switch is closed and whether the closed contact reaches a steady state. Upon determining that the contact is closed and reaches a steady state, in operation 806, the control system 702 turns off switches 706 and 732 to disable the forward current flowing through the coil 730. When the forward current flow is disabled, back EMF may be generated by the coil 730 in response to the sudden loss of current supplied by the first power source 718. It is advantageous to reduce the back EMF in order to provide a precise and consistent relay open time of the power control system.

In operation 808, switches 746 and 724 are turned on by the control system 702 to enable current flow through the coil 730 in the reverse direction. The reverse current is provided by the second power source 734. The reverse current can absorb the back EMF generated by the coil 730. When the switch 746 is turned on, a voltage is applied to the gate terminal of the switch 738 and the switch 738 is turned on. Current from the second power source 734 flow through the switch 738 to the coil 730 and flow through the coil 730 in the reverse direction to the switch 724.

In operation 810, the control system 702 determines a time period for providing the reverse current in order to eliminate core flux in the switch of the power control system. In some embodiments, the time period may be related to the material of the coil 730 and/or of the power level of the first power source 718.

In operation 812, the control system 702 turns off the switches 724 and 746 to disable the reverse current flowing through the coil 730 in the reverse direction after the determined time period.

Figure 9:
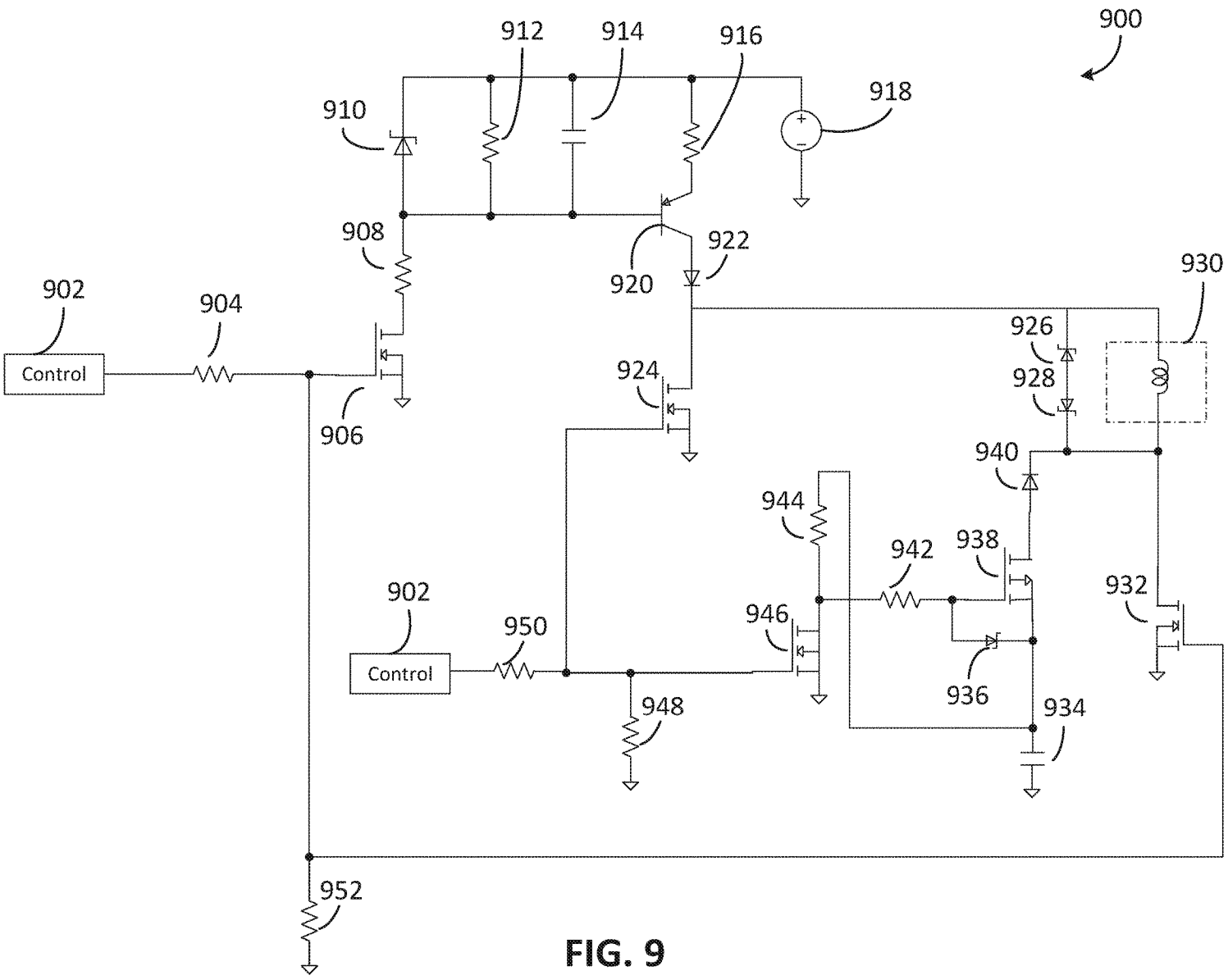
FIG. 9 is a circuit diagram for providing reverse current to a coil of a power control system according to an illustrative embodiment.

FIG. 9 shows a circuit 900 that is employed to provide reverse current to a coil of a power control system according to an illustrative embodiment. The circuit 900 includes a coil 930, a power source 918, a capacitor 934, and a control system 902. The coil 930 (e.g., a relay coil) is used to control movement of a contact in a switch of the power control system. The power source 918 may be DC power source. In some embodiments, the power source 918 may be an AC power source. The power source 918 is configured to provide forward voltage to the circuit 900. The capacitor 934 is configured to provide reverse voltage to the circuit 900.

The power source 918 is configured to provide forward voltage and forward current to the coil 930 in a first direction (e.g., forward direction). Current from the power source 918 is controlled by a switch 920, a switch 906, and a switch 932. In some embodiments, a resistor 916 may be disposed between the power source 918 and the switch 920 to absorb voltage. The switch 920 is controlled by voltage at a gate terminal. The gate terminal of the switch 920 is connected to a node between a resistor 908 and a resistor 912 and further connected to the switch 906. The switch 906 is controlled by control signals received from the control system 902. In some embodiments, a resistor 904 may be disposed between the control system 902 and the switch 906 to absorb voltage. When the control system 902 applies a voltage at a gate terminal of the switch 906 and the applied voltage reaches a threshold of the switch 906, the switch 906 closes to allow current flowing from the power source 918 through the resistor 912 and the resistor 908. When the voltage between the resistors 908 and 912 reaches a threshold of the switch 920, the switch 920 closes to allow current flowing from the power source 918 to the coil 930 in the first direction. The switch 932 received control signal (e.g., voltage) at a gate terminal from the control system 902. When the voltage applied at the gate terminal of the switch 932 reaches a threshold, the switch 932 closes. When the switches 920 and 932 are both closed, current flow through the coil 930 in the first direction. In other words, the coil 930 is energized. In some embodiments, a Zener diode 910 and a capacitor 914 may be disposed in parallel with the resistor 912 as a voltage regulator to provide a constant voltage to the resistor 912. In some embodiments, a diode 922 is connected between the switch 920 and the coil 930 to block reverse current. In some embodiments, a Zener diode 926 and a Zener diode 928 are coupled in a back to back configuration, e.g., where the anodes of both diodes are coupled together, in parallel to the coil 930. The Zener diode 926 and the Zener diode 928 are configured to quickly reduce forward current (e.g., current in the first direction) through the coil 930 until the coil 930 is fully discharged when the switches 906 and 932 are open.

The capacitor 934 is configured to provide reverse voltage and reverse current to the coil 930 in a second direction (e.g., reverse direction). The capacitor 934 is charged with a desired amount of energy to eliminate the relay coil core flux when the relay is opening. In some embodiments, the capacitor 934 can be charged in any suitable means, such as charged by the power source 918, or any suitable external power source. In some embodiments, the capacitor 934 is charged by a charge circuit that is not shown. Current from the capacitor 934 is controlled by a switch 946, a switch 924, and a switch 938. A first end of the capacitor 934 is connected between the switch 938 and a resistor 944. In some embodiments, the resistor 944 is disposed between the capacitor 934 and the switch 946 to absorb voltage. In some embodiments, a resistor 942 may be disposed between the switch 938 and a node between the resistor 944 and the switch 946. The switch 946 is controlled by voltage at a gate terminal. The gate terminal of the switch 946 is connected to the control system 902. The switch 946 is controlled by control signals received from the control system 902. In some embodiments, a resistor 950 may be disposed between the control system 902 and the switch 946 to absorb voltage. When the control system 902 applies a voltage at a gate terminal of the switch 946 and the applied voltage reaches a threshold of the switch 946, the switch 946 closes to allow current flowing from the capacitor 934 through the resistor 944 and the resistor 942. When current flows through the resistor 944, a voltage is applied to the gate terminal of the switch 938. When the voltage applied to the gate terminal of the switch 938 reaches a threshold, the switch 938 closes to enable current flow from the capacitor 934 to the coil 930. In some embodiments, a Zener diode 936 is connected between the gate terminal of the switch 938 and a first terminal of the switch 938 to protect the switch 938 from overload damage. In some embodiments, a diode 940 is connected between the switch 938 and the coil 930 to block forward coil current. The switch 924 is connected between the coil 930 and the control system 902. When the switch 946 is turned on, the switch 924 is turned on as well, so that the current from the capacitor 934 is enabled to flow through the switch 938, the coil 930, and the switch 924. In some embodiments, the switches 906, 920, 924, 944, 938, 932, and 946 may be any suitable type of solid-state switches (e.g., SCRs, MOSFETs, IGBTs, and/or GTOs).

Figure 10:
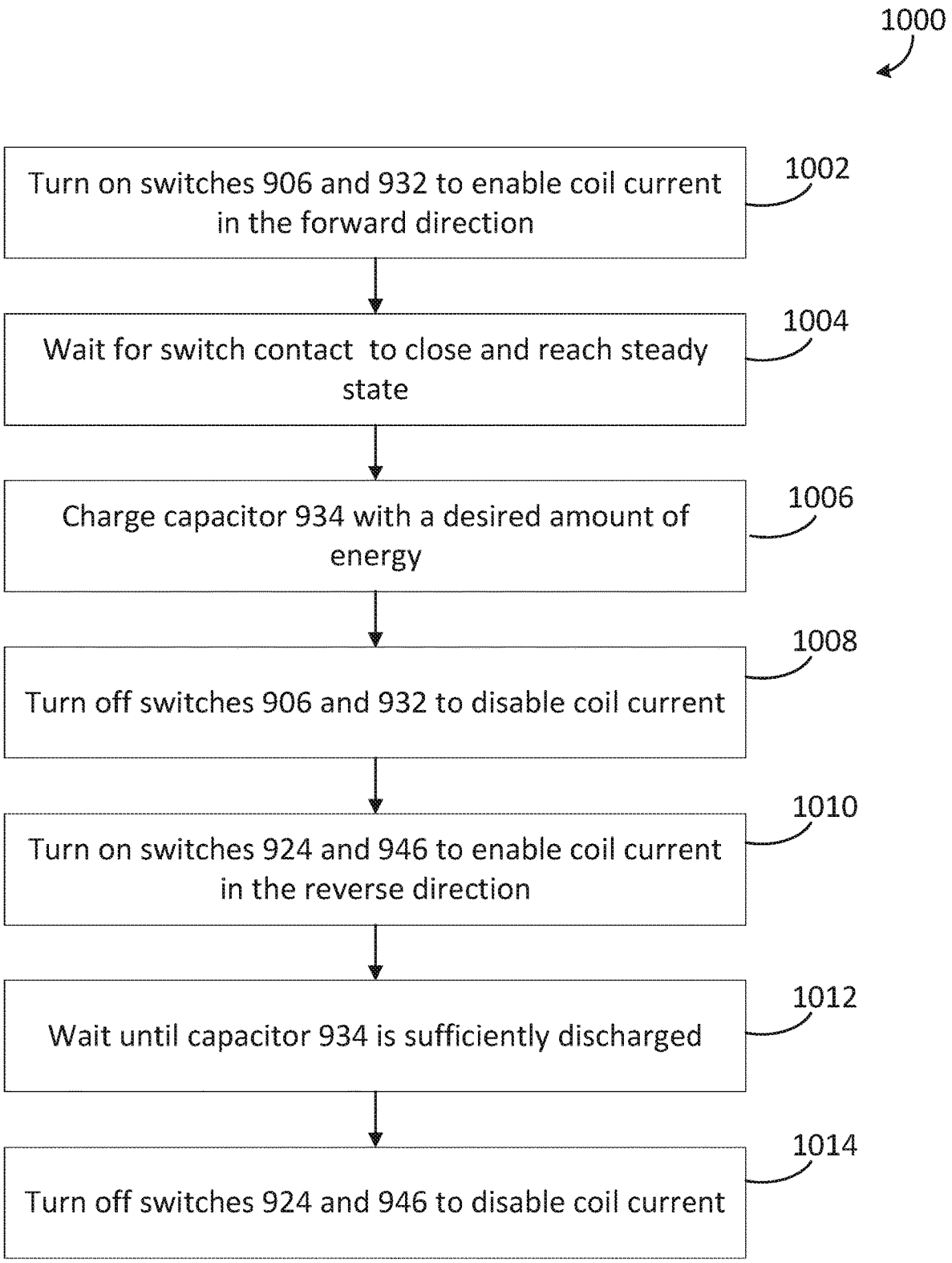
FIG. 10 is flow chart of a process of operating the circuit of FIG. 9 according to an illustrative embodiment.

FIG. 10 is flow chart of a process 1000 of operating the circuit 900 of FIG. 9 according to an illustrative embodiment. The process 1000 is controlled by the control system 902 to control movement of a contact in a switch of a power control system. In operation 1002, switches 906 and 932 are turned on by the control system 902 to enable current from the power source 918 to flow through the coil 930 in the forward direction. When the switch 906 is turned on, a voltage is applied to the gate terminal of the switch 920 to turn on the switch 920. Current from the power source 918 flows through the resistor 916 and the switch 920 to the coil 930. When the forward current flow through the coil 930, the coil 930 is energized to provide an electromagnetic force to close the contact of the switch.

In operation 1004, the control system 902 determines whether the contact of the switch is closed and whether the closed contact reaches a steady state. In operation 1006, the capacitor 934 is charged with a desired amount of energy. The charged amount of energy is determined so that the capacitor can provide enough energy to eliminate the relay coil core flux when the relay is opening. The capacitor is charged from a separate power source according to some embodiments.

Upon determining that the contact is closed and reaches a steady state and upon determining that the capacitor 934 is charged with the desired amount of energy, in operation 1008, the control system 902 turns off switches 906 and 932 to disable the forward current flowing through the coil 930. When the forward current flow is disabled, back EMF may be generated by the coil 930 in response to the sudden loss of current supplied by the first power source 918. It is advantageous to reduce the back EMF in order to provide a precise and consistent relay open time of the power control system.

In operation 1010, switches 946 and 924 are turned on by the control system 902 to enable current flow through the coil 930 in the reverse direction. The reverse current is provided by the capacitor 934. The reverse current can absorb the back EMF generated by the coil 930. When the switch 946 is turned on, a voltage is applied to the gate terminal of the switch 938 and the switch 938 is turned on. Current from the capacitor 934 flow through the switch 938 to the coil 930 and flow through the coil 930 in the reverse direction to the switch 924.

In operation 1012, the control system 902 whether the capacitor 934 is sufficiently discharged.

In operation 1014, upon determining that the capacitor 934 is sufficiently discharged, the control system 902 turns off the switches 924 and 946 to disable the reverse current flowing through the coil 930 in the reverse direction.

Figure 11:
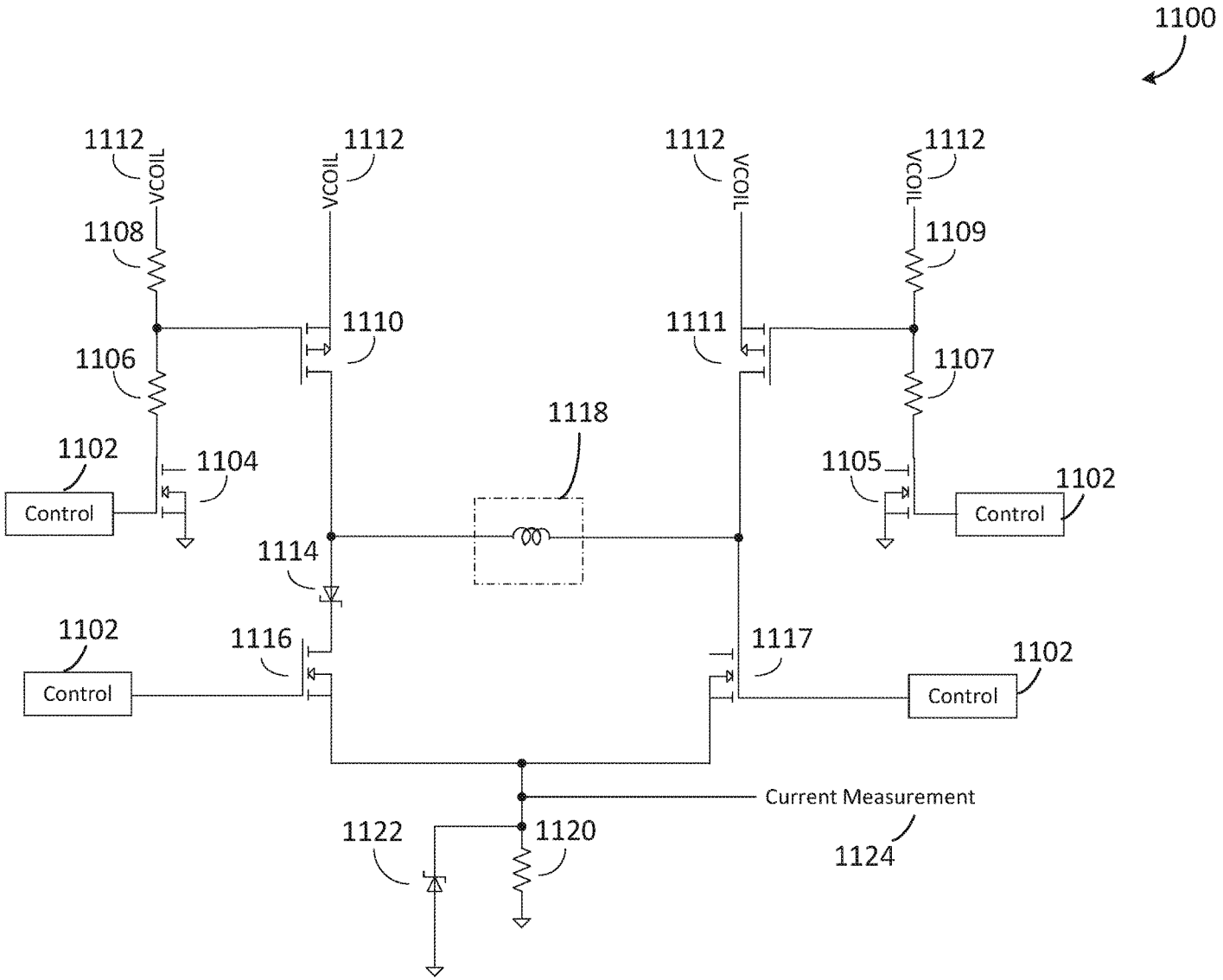
FIG. 11 is a circuit diagram for providing reverse current to a coil of a power control system according to an illustrative embodiment.

FIG. 11 shows a circuit 1100 that is employed to provide reverse current to a coil of a power control system according to an illustrative embodiment. The circuit 1100 has a H-Bridge design. The circuit 1100 includes a coil 1118, a power source 1112, and a control system 1102. The coil 1118 (e.g., a relay coil) is used to control movement of a contact in a switch of the power control system. The power source 1112 may be DC power source. In some embodiments, the power source 1112 may be an AC power source.

The power source 1112 is connected to a first end of the coil 1118 through a switch 1110. The switch 1110 is controlled by signals received at a gate terminal. The gate terminal is connected to a node that is between a resistor 1108 and a resistor 1106. The resistor 1108 is connected to the power source 1112. The resistor 1106 is connected to a switch 1104. The switch 1104 is controlled by the control system 1102 through a connection between a gate terminal of the switch 1104 and the control system 1102. When the switch 1104 is turned on, voltage is applied to the gate terminal of the switch 1110 to turn on the switch 1110. A switch 1117 is connected between a second end of the coil 1118 and the control system 1102. When the switch 1117 and the switch 1104 are turned on, current from the power source 1112 flows through the switch 1110, the coil 1118, and the switch 1117 in a forward direction.

The power source 1112 is connected to a second end of the coil 1118 through a switch 1111. The switch 1111 is controlled by signals received at a gate terminal. The gate terminal is connected to a node that is between a resistor 1109 and a resistor 1107. The resistor 1109 is connected to the power source 1112. The resistor 1107 is connected to a switch 1105. The switch 1105 is controlled by the control system 1102 through a connection between a gate terminal of the switch 1105 and the control system 1102. When the switch 1105 is turned on, voltage is applied to the gate terminal of the switch 1111 to turn on the switch 1111. A switch 1116 is connected between the first end of the coil 1118 and the control system 1102. When the switch 1116 and the switch 1105 are turned on, current from the power source 1112 flows through the switch 1111, the coil 1118, and the switch 1116 in a reverse direction. In some embodiments, a Zener diode 1114 is disposed between the switch 1116 and the first end of the coil 1118. The Zener diode 1114 is configured to control the relay coil current fall time before the current is reversed in direction. In some embodiments, a short circuit may be used to replace the Zener diode 1114. In some embodiments, a current measurement means 1124 is used to regulate coil current in a feedback control loop by pulse-width modulating (PWM) the control signal from the control system 1102.

Figure 12:
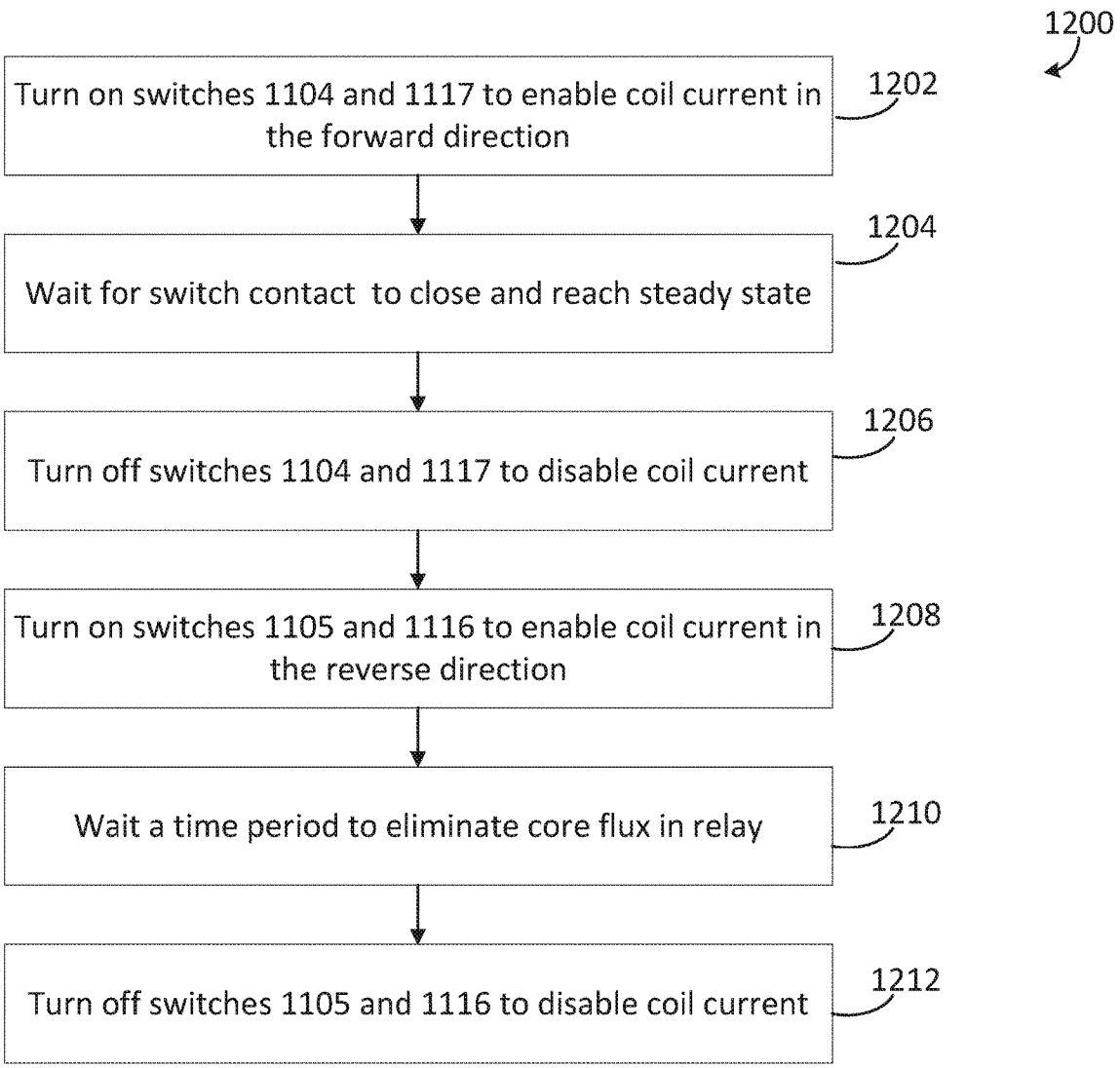
FIG. 12 is flow chart of a process of operating the circuit of FIG. 11 according to an illustrative embodiment.

FIG. 12 is flow chart of a process 1200 of operating the circuit 1100 of FIG. 11 according to an illustrative embodiment. The process 1200 is controlled by the control system 1102 to control movement of a contact in a switch of a power control system. In operation 1202, switches 1104 and 1117 are turned on by the control system 1102 to enable current from the power source 1112 to flow through the coil 1118 in the forward direction. When the switch 1104 is turned on, a voltage is applied to the gate terminal of the switch 1110 to turn on the switch 1110. Current from the power source 1112 flows through the switch 1110 to the coil 1118. When the forward current flow through the coil 1118, the coil 1118 is energized to provide an electromagnetic force to close the contact of the switch.

In operation 1204, the control system 1102 determines whether the contact of the switch is closed and whether the closed contact reaches a steady state. Upon determining that the contact is closed and reaches a steady state, in operation 1206, the control system 1102 turns off switches 1104 and 1117 to disable the forward current flowing through the coil 1118. When the forward current flow is disabled, back EMF may be generated by the coil 1118 in response to the sudden loss of current supplied by the first power source 1112. It is advantageous to reduce the back EMF in order to provide a precise and consistent relay open time of the power control system.

In operation 1208, switches 1105 and 1116 are turned on by the control system 1102 to enable current flow through the coil 1118 in the reverse direction. The reverse current can absorb the back EMF generated by the coil 1118. When the switch 1105 is turned on, a voltage is applied to the gate terminal of the switch 1111 and the switch 1111 is turned on. Current from the power source 1112 flow through the switch 1111 to the coil 1118 and flow through the coil 1118 in the reverse direction to the switch 1116.

In operation 1210, the control system 1102 determines a time period for providing the reverse current in order to eliminate core flux in the switch of the power control system. In some embodiments, the time period may be related to the material of the coil 1118 and/or of the power level of the power source 1112.

In operation 1212, the control system 1102 turns off the switches 1105 and 1116 to disable the reverse current flowing through the coil 1118 in the reverse direction after the determined time period.

As used herein, a "control system" and/or "controller" can include any computer-based device such as an analog or digital computer, or a micro-controller or a single-board computer (SBC) or a personal computer (PC) or any industrial controller that can be configured with software and operable within some environment to change the environment (e.g. change speed, change temperature, or alter position). For example, a controller can be a programmable automation controller (PAC) and/or a programmable logic controller (PLC). The term "controller" as utilized herein can include functionality that can be shared across multiple computer components or networks. Additionally, a controller could be a hardware controller or a software controller operating to change a process.

For example, the control system can include a memory to store data and/or control instructions, algorithms, model structure, model information such as model parameters, design information and historical information among other programs, data, control, historical data and/or operating information. This can be stored on one or more processors or distributed across multiple processors. The multiple processors can be physically located on the same circuit board, in the same enclosure, in the same control room, or distributed in several or more locations linked through one or more network or data communications facilities.

The control system can also include a plurality of inputs and outputs (I/O). For example, the inputs can be used to accept signals from sensors indicating the condition of the plant and/or process. The outputs can provide an electrical signal to cause an actuator to move or a contact to close (or open), thereby affecting the state of the system. The controller output can be combined with other stored information and presented for display, printing and/or archival storage. The controller output can be a control signal or setpoint value to another, lower level controller, such as a motor speed controller with current, speed, and/or torque limiting capabilities. The lower level controller can then implement an inner feedback loop to maintain motor speed and/or torque until another control action change, such as a setpoint change, is received from the higher-level controller. Note that the level of controllers can be cascaded and/or can include multiple levels of control and/or multiple parallel controllers. The term "model," as applied herein, can represent an "algorithm" that is a part of a software program. For example, the model can be a software program that is stored in the controller's memory and executed by one or more of the controller's processors.

As used in this application, the terms "component," "module," "agent," "algorithm," "system," "interface," "model," or the like are generally intended to refer to a computer-related entity, either hardware, a combination of hardware and software, software, or software in execution. For example, a component can be, but is not limited to being, a process running on a processor, a processor, an object, an executable, a thread of execution, a program, and/or a computer. "Software" can include firmware, interpreted code, compiled logic, executable instructions, and/or hardwired logic can be implemented in digital, analog, or mixed (analog and digital) form. By way of illustration, both an application running on a controller and the controller can be a component. One or more components can reside within a process and/or thread of execution and a component can be localized on one computer and/or distributed between two or more processors in a single computer (e.g. multi-core computers) or in multiple distinct local or distributed computers or any combination of these configurations. As another example, an interface can include input/output (I/O) components as well as associated processor, application, and/or application programming interface (API) components.

It is noted that as used in this application, terms such as "component," "module," "agent," "model," "system," and the like are intended to refer to a computer-related, electromechanical entity or both, either hardware, a combination of hardware and software, software, or software in execution as applied to an automation system for industrial control. For example, a component can be, but is not limited to being, a process running on a processor, a processor, an object, an executable, a thread of execution, a program and a computer. By way of illustration, both an application running on a server and the server can be components. One or more components can reside within a process or thread of execution and a component can be localized on one computer or distributed between two or more computers, apparatuses, or modules communicating therewith.

The subject matter as described above includes various exemplary aspects. However, it should be appreciated that it is not possible to describe every conceivable component or methodology for purposes of describing these aspects. One of ordinary skill in the art can recognize that further combinations or permutations can be possible. Various methodologies or architectures can be employed to implement the various embodiments, modifications, variations, or equivalents thereof. Accordingly, all such implementations of the aspects described herein are intended to embrace the scope and spirit of subject claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A device, comprising:

an armature configured to move between a close position that electrically couples the armature to a contact and an open position that is not electrically coupled to the contact;

a coil configured to release a voltage to de-magnetize the coil, thereby causing the armature to move from the close position to the open position; and a circuit configured to provide a forward driving current to the coil to magnetize the coil, thereby causing the armature to move from the open position to the close position, and to provide a reverse driving current to the coil during a period of time when the armature moves from the close position to the open position when the coil generates a back electromotive force in response to a loss of the forward driving current, wherein the circuit provides the reverse driving current concurrently with the coil generating the back electromotive force whereby the reverse driving current absorbs the back electromotive force.

2. The device of claim 1, further comprising:

a first power source configured to provide the forward driving current to the coil; and a second power source configured to provide the reverse driving current to the coil.

3. The device of claim 1, wherein the circuit comprises a first switch and a second switch configured to be turned on to enable the forward driving current to flow through the coil and to be turned off to disable the forward driving current flowing through the coil.

4. The device of claim 3, wherein the circuit comprises a third switch and a fourth switch configured to be turned on to enable the reverse driving current to flow through the coil and be turned off to disable the reverse driving current flowing through the coil.

5. The device of claim 4, wherein the first switch and the third switch are connected to a first end of the coil and the second switch and the fourth switch are connected to a second end of the coil.

6. The device of claim 1, wherein the circuit includes a Zener diode, a resistor, and a capacitor, wherein the Zener diode and the capacitor are arranged in parallel with the resistor.

7. A circuit configured to provide a reverse coil drive current for a switching system, comprising:

a coil;

a first power source connected to a second end of the coil;

a first switch connected to a first end of the coil; and a second switch connected to the second end of the coil, wherein when the first switch and the second switch are turned on, a current from the first power source is enabled to flow through the coil from the second end to the first end to provide a forward driving current to the coil to magnetize the coil when the switching system moves from an open state to a closed state, wherein when the first switch and the second switch are turned off, the circuit is configured to provide a reverse driving current to the coil during a period of time when the switching system moves from the closed state to the open state when the coil generates a back electromotive force in response to a loss of the forward driving current, wherein the circuit provides the reverse driving current concurrently with the coil generating the back electromotive force whereby the reverse driving current absorbs the back electromotive force.

8. The circuit of claim 7, further comprising a second power source connected to the first end of the coil.

9. The circuit of claim 8, wherein the first power source and the second power source are different power sources.

10. The circuit of claim 8, wherein the first power source and the second power source are a same power source.

11. The circuit of claim 8, further comprising:

a third switch connected to the first end of the coil; and a fourth switch connected to the second end of the coil, wherein when the third switch and the fourth switch are turned on, a current from the second power source is enabled to flow through the coil from the first end to the second end, wherein when the third switch and the fourth switch are turned off, the current from the second power source is disabled from flowing through the coil from the first end to the second end.

12. The circuit of claim 11, wherein the first and the second switches are turned on after the third and the fourth switches are turned off so that core flux of the coil is eliminated.

13. The circuit of claim 7, wherein the first power source comprises a capacitor.

14. The circuit of claim 13, wherein the first and the second switches are turned off when the capacitor is sufficiently discharged.

15. A method of driving a coil of a switching system, comprising:

enabling, by a circuit, a current flowing through the coil in a forward direction to magnetize the coil thereby changing the switching system from an open state to a closed state;

disabling, by the circuit, the current flowing through the coil in the forward direction; and enabling, by the circuit, a current flowing through the coil in a reverse direction during a period of time when the switching system moves from the closed state to the open state when the coil generates a back electromotive force in response to a loss of the current flowing through the coil in the forward direction, to eliminate core flux of the coil, wherein the current flowing through the coil in the reverse direction occurs concurrently with the coil generating the back electromotive force whereby the current flowing through the coil in the reverse direction absorbs the back electromotive force.

16. The method of claim 15, further comprising:

determining whether the switching system reaches a steady closed state; and upon determining that the switching system reaches the steady closed state, disabling, by the circuit, the current flowing through the coil in the forward direction.

17. The method of claim 15, wherein enabling and disabling the current flowing through the coil in the reverse direction comprises turning on and off a first and a second switches connected to the coil in different ends.

18. The method of claim 15, enabling and disabling the current flowing through the coil in the forward direction comprises turning on and off a third and a fourth switches connected to the coil in different ends.

19. The device of claim 4, wherein a control system is connected to the circuit and configured to:

turn on the first and the second switches and turn off the third and the fourth switches to enable the forward driving current through the coil;

determine whether the armature is turned to the close position and reaches a steady state; and upon determining that the armature is in the close position and reaches the steady state, turn off the first and the second switches to disable the forward driving current.

20. The device of claim 19, wherein the control system is further configured to:

turn on the third and the fourth switches for the period of time after the first and the second switches being turned off to enable the reverse driving current to flow through the coil, wherein the period of time is determined so that core flux in the coil is eliminated; and turn off the third and the fourth switches to disable the reverse driving current flowing through the coil.

* * * * *